United States Patent [19]

Glamm et al.

[11] Patent Number: 4,576,011

[45] Date of Patent: Mar. 18, 1986

[54] AIR CONDITIONING SYSTEM AND METHOD OF OPERATION

[75] Inventors: Paul R. Glamm; James C. Wendschlag, both of La Crosse, Wis.

[73] Assignee: Electric Power Research Institute, Palo Alto, Calif.

[21] Appl. No.: 641,413

[22] Filed: Aug. 16, 1984

Related U.S. Application Data

[63] Continuation of Ser. No. 437,903, Nov. 1, 1982, abandoned.

[51] Int. Cl.[4] ..... F25B 1/00

[52] U.S. Cl. ..... 62/115; 62/197; 62/324.6

[58] Field of Search ..... 62/324.6, 324.1, 205, 62/81, 197, 115, 278

[56] References Cited

U.S. PATENT DOCUMENTS 3,041,845 7/1962 Trask ..... 62/324.1 X 3,190,079 6/1965 Lauer ..... 62/324.1 X

*Primary Examiner*—William E. Wayner

*Attorney, Agent, or Firm*—James P. Hillman

[57] ABSTRACT

An air conditioning system and method of operation for reducing cyclic losses due to non-steady state operation at the start of operating cycles are disclosed. A bi-flow expansion valve assembly is provided in the refrigerant line between the heat exchangers, and the valve assembly can meter refrigerant flow between the heat exchangers or can permit substantially unrestricted flow therethrough. At the start of a cycle, the valve assembly is adjusted to allow refrigerant to flood between the heat exchangers, thereby correcting mislocation of refrigerant caused by the migration of refrigerant to the evaporator during the off-cycle, or caused when heat exchanger functions are switched, as, for example, during a defrost cycle of a heat pump.

12 Claims, 1 Drawing Figure

AIR CONDITIONING SYSTEM AND METHOD OF OPERATION

This application is a continuation of application Ser. No. 06/437,903, filed on Nov. 1, 1982, now abandoned.

DESCRIPTION

Background Art i. Technical Field

The invention disclosed herein pertains broadly to the field of refrigeration and more specifically to systems and methods for commencing an operating cycle of a refrigeration device to minimize the cyclic losses caused by non-steady state operation.

ii. Prior Art

Increased energy costs have caused an increasing demand for efficient heating and cooling systems of all types and sizes. Heat pumps have rapidly gained in popularity, in large part as a result of the efficiency of heat pumps as compared with conventional heating systems. The efficiencies of heat pumps themselves also have been improved, primarily by improving the efficiencies of the compressors, fans and motors used in the heat pump. Larger coils are used in newer heat pump designs to improve seasonal performance by increasing the steady state operating efficiency.

In steady state operation of an air conditioning system approximately 65–80% of the refrigerant charge is located in the high pressure side of the system. During extended periods of off-time much of the refrigerant will migrate to the evaporator, in that the evaporator is generally at a lower ambient temperature than the condenser. At the start of the next operating cycle the excess refrigerant charge in the low side of the system must be pumped to the high side of the system to achieve steady state operation. Liquid refrigerant in the evaporator flows to the accumulator, the suction pressure drops to a value low enough to vaporize the liquid, and the compressor pumps the vapor to the condenser. This process can take several minutes, during which time the air conditioning system does not operate at steady state capacity. The cyclic losses are greater in systems having larger coil sizes as a result of the greater amount of refrigerant charge in such systems. In a typical heat pump the period during which refrigerant is being pumped from the evaporator to the condenser to achieve steady state operation may be six minutes or longer.

A similar problem occurs during a defrost cycle of a heat pump, both upon initiation of the defrost cycle and upon termination thereof and resumption of heating mode operation. When the cycle is reversed, both at the start and at the completion of a defrost cycle, refrigerant is flooded to the accumulator to be gradually boiled therefrom to achieve steady state operation. Thus, the heating efficiency of the heat pump is reduced by the inefficiencies resulting from improper refrigerant location when heat exchanger functions are reversed at the commencement of the defrost cycle and at the resumption of heating mode operation. The time required for defrost is lengthened as a result of the cyclic loss at the start of a defrost cycle, and the amount of supplemental heat required is increased due to both cyclic losses.

Isolating each coil with solenoid valves substantially reduces the migration of refrigerant during the off-cycle caused by temperature differences. While normal cyclic losses caused by refrigerant migration can be reduced in this manner, no reduction is achieved in the cyclic losses of the defrost cycle which occur because of reversal of heat exchanger functions and the resultant mislocation of refrigerant. Additionally, as a result of the large pressure differential across the compressor at start-up, a hard-start kit must be included in such a system. The cost savings from cyclic loss reductions do not generally justify the additional equipment required when the coils are isolated by solenoid valves.

SUMMARY OF THE INVENTION

It is therefore one of the principal objects of the present invention to provide an air conditioning system and a method for operating the system which result in rapid attainment of a steady state operating condition, thereby significantly reducing cyclic losses caused by non-steady state operation.

Another object of the present invention is to provide an air conditioning system and a method for operating the system which eliminate the need for an accumulator and compensate for refrigerant migration without requiring hard-start kits.

A further object of the present invention is to provide a method for operating an air conditioning device which substantially reduces cyclic losses in a heat pump occurring as a result of non-steady state operation caused by improper refrigerant location due to reversal of heat exchanger functions, both at commencment of a defrost cycle and at resumption of normal heating mode operation.

These and other objects are achieved in the present invention by providing a bi-flow expansion valve assembly in the refrigerant line between the heat exchangers of a conventional air conditioning device. A reversing valve is provided in the discharge line from the compressor, and at the start of a cycle the reversing valve is adjusted to a position for directing refrigerant flow opposite to the direction of the desired operating mode. The bi-flow expansion valve assembly is opened to provide virtually unrestricted flow through the refrigerant line between the heat exchangers. Liquid refrigerant from the evaporator-to-be is flooded to the condenser-to-be, and the bi-flow expansion valve assembly is closed to a metering condition. The reversing valve is adjusted for directing refrigerant in the proper direction for the desired operating mode, and normal operation is commenced.

In a heat pump, at the commencement of a defrost cycle, the bi-flow expansion valve assembly is opened to permit refrigerant to flood from the indoor coil to the outdoor coil. The reversing valve is then switched to the defrost mode, the bi-flow expansion valve assembly is adjusted to a refrigerant metering condition and defrost ensues. Upon completion of the defrost cycle the bi-flow expansion valve assembly is again opened to permit virtually unrestricted flow through the refrigerant line, the liquid refrigerant is flooded to the indoor coil, the reversing valve is adjusted to the heating mode of operation and the bi-flow expansion valve assembly is closed to a refrigerant metering condition.

These and other objects of the present invention will become apparent from the following detailed description and the accompanying drawing.

DETAILED DESCRIPTION OF THE PREFERRED EMBODIMENTS

Figure 1:
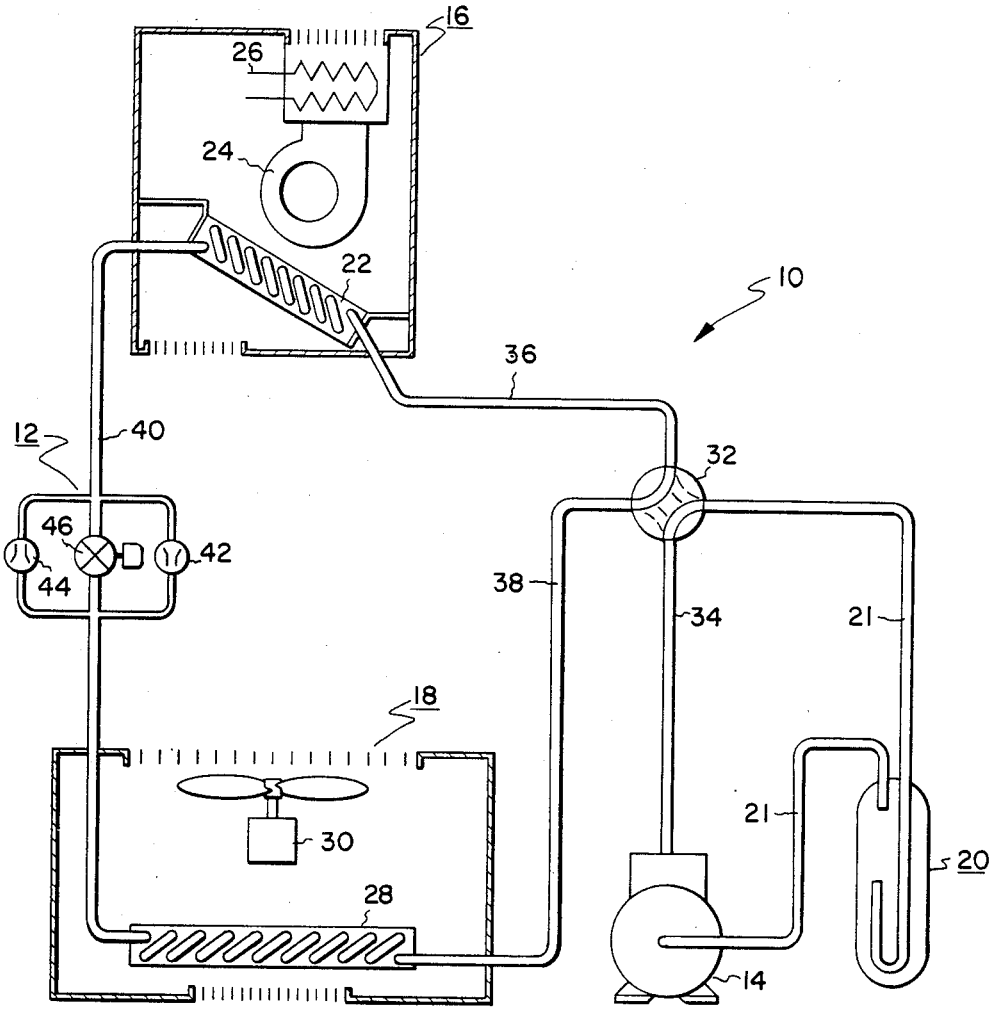
FIG. 1 is a schematic view of a heat pump having a bi-flow expansion valve assembly for operating in accordance with the methods of the present invention.

Referring now more specifically to the drawing, numeral 10 designates a heat pump of substantially conventional design, but having a bi-flow expansion valve assembly 12 which enables the heat pump to operate according to the methods of the present invention. The bi-flow expansion valve assembly replaces the expansion devices and check valves typically found in the refrigerant line between the heat exchangers of a heat pump. The operation of the bi-flow expansion valve assembly will be described more fully hereinafter. The heat pump also includes a compressor 14, an indoor heat exchanger assembly 16 and an outdoor heat exchanger assembly 18. An accumulator 20 is provided in the compressor suction line 21; however, it is contemplated that operating an air conditioning device using the present methods may obviate the need for an accumulator.

Indoor heat exchanger assembly 16 includes a refrigerant-to-air heat exchange coil 22 and a fan 24, and the assembly is also shown with a backup electrical resistant heating coil 26. Outdoor heat exchanger assembly 18 includes a refrigerant-to-air heat exchange coil 28 and a fan 30. The indoor and outdoor heat exchanger assemblies are of conventional design and will not be described further herein. A reversing valve 32 is connected to the compressor discharge port by a refrigerant line 34, to the compressor suction port by suction line 21 and to coils 22 and 28 by refrigerant lines 36 and 38, respectively. The reversing valve is also of conventional design for directing high pressure refrigerant vapor from the compressor to either the indoor coil during heating mode operation or to the outdoor coil for cooling mode operation or for defrost, and for returning refrigerant from the coil operating as an evaporator to the compressor.

A refrigerant line 40 is disposed between the indoor coil 22 and the outdoor coil 28, and the aforementioned bi-flow expansion valve assembly 12 is disposed in the refrigerant line 40. Although the bi-flow expansion valve assembly may encompass many different valve structures cooperating in function, or a single complex valve capable of unrestricted flow therethrough and metered flow in either direction, schematically the assembly has been shown to include metering passages 42 and 44 for metering refrigerant therethrough along paths toward, respectively, the indoor coil 22 and the outdoor coil 28. A solenoid valve 46 or the like is disposed in the line 40, and valve 46 may be opened to permit unrestricted refrigerant flow therethrough in line 40, or may be closed to cause refrigerant to flow only through either the metering orifice 42 or the metering orifice 44, which are connected to refrigerant line 40 by branch lines 48 and 50 bypassing the flowthrough path of the valve assembly containing solenoid valve 46.

With the basic structure of a heat pump of the invention having been fully described, operation of the heat pump in accordance with the methods of the present invention will now be described more completely, with respect to each operating mode.

At the start of a cooling mode cycle, refrigerant will have migrated to the indoor coil 22 as a result of the cooler ambient temperatures in the indoor unit. For steady state operation approximately 65 to 80% of the refrigerant should be located in the high pressure side including outdoor coil 28. To rapidly achieve this condition at the commencement of the operating cycle, the bi-flow expansion valve assembly 12 is adjusted to a flow-through, unrestricted condition wherein valve 46 is opened, and refrigerant flow is restricted only by the capacity of line 40. Reversing valve 32 is adjusted to the position for heating mode operation wherein high pressure refrigerant vapor is directed to the indoor coil 22. The compressor is started, and the excess liquid refrigerant in the indoor coil is rapidly pumped through the bi-flow expansion valve assembly to the outdoor coil. When the liquid refrigerant has been pumped out of the indoor coil, which may take only a matter of seconds, the bi-flow expansion valve assembly 12 is adjusted to a metering condition wherein the flow-through passage having valve 46 is closed. Reversing valve 32 is adjusted to the proper position for cooling mode operation wherein the refrigerant vapor is directed to the outdoor coil. Conventional cooling mode operation then follows.

During heating mode operation a reverse procedure to that just described for cooling mode operation is followed. Excess liquid refrigerant will have migrated to the outdoor coil which is at a lower ambient temperature than the indoor coil. At initiation of a heating cycle the reversing valve 32 is adjusted to a cooling mode operating position, the bi-flow expansion valve assembly 12 is adjusted to an unrestricted flow condition wherein valve 46 is fully opened and the compressor is started to flood refrigerant from the outdoor coil to the indoor coil. After this is accomplished, the bi-flow expansion valve assembly is adjusted to a refrigerant metering condition wherein valve 46 is closed. The reversing valve is adjusted to heating mode operation and a conventional heating cycle follows. Again, the refrigerant has been properly located in the heat pump within a matter of seconds, thereby eliminating the often-encountered many minutes of non-steady state operation found in conventional systems.

When a defrost cycle is required, initially the reversing valve is in a position for heating mode operation and normally the compressor will be operating. With the reversing valve remaining in the position for heating mode operation, the bi-flow expansion valve assembly is adjusted to an unrestricted flow condition wherein valve 46 is fully opened, the compressor continues operating and refrigerant from the indoor coil is pumped rapidly to the outdoor coil. The bi-flow expansion valve assembly is then adjusted to a refrigerant metering condition, reversing valve 32 is adjusted to a cooling mode operating condition for defrost and the defrost cycle follows. Upon completion of the defrost cycle, the reversing valve 32 is left in the position for cooling or defrost mode operation, bi-flow expansion valve assembly 12 is adjusted to an unrestricted flow condition and the liquid refrigerant is pumped rapidly from the outdoor coil to the indoor coil. The bi-flow expansion valve assembly is adjusted to a fluid metering position, and the reversing valve is adjusted to a heating mode operating position to complete the cycle.

Substantial energy savings can result from using the present methods, particularly during the defrost mode in that many minutes of non-steady state operation are eliminated, both at the commencement of a defrost cycle and at resumption of a heating mode cycle. The defrost cycle is made more efficient, thereby reducing the amount of time required for defrost and reducing the required back-up heat. Basic cooling and heating cycles are made more efficient by reducing cyclic losses, thereby reducing on-cycle times and decreasing energy consumption.

The present invention works equally as well in a cooling-only air conditioning system. In such a system a reversing valve and bi-flow expansion valve assembly must be added to the system. At the start of each cooling cycle the system operates as described previously herein for the cooling cycle of a heat pump.

It is also contemplated that the bi-flow expansion valve assembly can be used to control the amount of superheat leaving the evaporator. A solid state controller can be used to optimize superheat to existing operating conditions as well as to control the system at the start of operating cycles. Thus, in addition to improving overall system efficiency by minimizing non-steady state operating times, the present invention can also be used to improve steady state operation and further increase the efficiency of an air conditioning system.

Although an air conditioning system and a method for the operation thereof have been shown and described in detail herein with particular reference to a heat pump system, it should be understood that various modifications may be made without departing from the scope of the present invention.

We claim:

1. A method for rapidly achieving steady state operation in a desired operating mode of an air conditioning device having a compressor, a heat exchanger which operates as a condenser in the mode and a heat exchanger which operates as an evaporator in the mode, said method comprising the sequential steps at start up of:

a. providing a substantially unrestricted path for the flow of refrigerant from said evaporator to said condenser;
b. flooding refrigerant from said evaporator to said condenser through the unrestricted path; and
c. providing a restricted path for metering refrigerant flow from said condenser to said evaporator during the desired operating mode.

2. The method defined in claim 1 in which said flooding step is performed by operating the compressor and directing compressed refrigerant vapor therefrom to said evaporator.

3. The method defined in claim 1 which further includes the sequential steps of:

a. providing a substantially unrestricted path for the flow of refrigerant from said condenser to said evaporator;
b. flooding refrigerant from said condenser to said evaporator;
c. providing a restricted path for metering refrigerant flow from said evaporator to said condenser;
d. operating the compressor and directing compressed refrigerant vapor from said compressor said evaporator to defrost said evaporator; and
e. repeating the steps of
   i. providing a substantially unrestricted path for the flow of refrigerant from said evaporator to said condenser;
   ii. flooding refrigerant from said evaporator to said condenser;
   iii. providing a restricted path for metering refrigerant flow from said condenser to said evaporator.

4. The method defined in claim 3 in which said flooding steps are performed by operating the compressor and directing compressed refrigerant vapor to the one of said condenser and evaporator from which refrigerant is flooded.

5. A method for operating an air conditioning device having a compressor; an evaporator; a condenser; refrigerant lines disposed between the compressor and the condenser, between the evaporator and the compressor and between the evaporator and the condenser; a first valve means disposed in the refrigerant line between the evaporator and the condenser, the valve means having a flow-through portion opened for an operating condition in which refrigerant can flow through said valve means substantially unrestricted by the valve means between the evaporator and the condenser, and a metering portion restricted when the valve means is in a condition in which the flow of refrigerant is metered between the condenser and the evaporator; and a reversing valve having first and second operating conditions for directing refrigerant vapor from the compressor to the condenser or the evaporator; said method comprising the steps of first a. placing the first valve means in the flow-through operating condition;
b. adjusting the reversing valve to direct refrigerant vapor from the compressor to the evaporator; and
c. operating the compressor to pump excess liquid refrigerant from the evaporator to the condenser through the flow-through portion of the first valve means; thereafter
d. placing the first valve means in the restricted operating condition for metering refrigerant flow from the condenser to the evaporator; and
e. adjusting the reversing valve to direct refrigerant vapor from the compressor to the condenser.

6. The methd for operating an air conditioning device as defined in claim 5, said method further including the steps of;

a. placing the first valve means in the flow-through operating condition while maintaining the reversing valve in a condition to pump refrigerant vapor to the condenser; and
b. pumping the excess liquid refrigerant from the condenser to the evaporator; then
c. placing the first valve means in the flow metering condition for metering refrigerant flow from the evaporator to the condenser; and
d. adjusting the reversing valve to direct refrigerant vapor from the compressor to the evaporator for defrosting the evaporator; and, at completion of defrost
e. reopening the first valve means to permit unrestricted refrigerant flow from the evaporator to the condenser, while maintaining the reversing valve in a condition to pump refrigerant vapor to the evaporator;
f. pumping excess liquid refrigerant from the evaporator to the condenser through the reopened first valve means;
g. returning the first valve means to a restricted operating condition for metering refrigerant flow from the condenser to the evaporator; and
h. repositioning the reversing valve to direct refrigerant vapor from the compressor to the condenser.

7. A method for operating a heat pump having indoor and outdoor heat exchangers functioning alternatively as the evaporator and the condenser during cooling and heating modes respectively; a compressor; refrigerant lines disposed between the heat exchangers and the compressor; a reversing valve having first and second positions for directing refrigerant from the compressor to the outdoor heat exchanger in a first operating mode and to the indoor heat exchanger in a second operating mode, respectively; and a bi-flow expansion valve assembly in a refrigerant line between the indoor and outdoor heat exchangers for metering refrigerant flow in either direction between the heat exchangers and for providing substantially unrestricted refrigerant flow through the refrigerant line between the heat exchangers; said method comprising the steps of:

a. placing the reversing valve in the position for directing refrigerant vapor to the heat exchanger which will function as an evaporator during the desired operating mode;
b. adjusting the bi-flow expansion valve assembly to permit virtually unrestricted refrigerant flow between the heat exchangers; and
c. operating the compressor to flood liquid refrigerant from the heat exchanger which will function as the evaporator during the desired operating mode to the heat exchanger which will function as the condenser during the desired operating mode; thereafter
d. placing the bi-flow expansion valve in a position for metering refrigerant flow between the heat exchangers; and
e. placing the reversing valve in the position for directing refrigerant vapor to the heat exchanger which will function as a condenser during the desired mode of operating.

8. The method for operating a heat pump as defined in claim 7 wherein the heat pump is operating in the second operating mode with the indoor heat exchanger functioning as a condenser and the outdoor heat exchanger functioning as an evaporator, said method further comprising the steps of:

a. adjusting the bi-flow expansion valve assembly for unrestricted flow therethrough from the indoor heat exchanger to the outdoor heat exchanger while maintaining the reversing valve in the second operating mode; and
b. flooding refrigerant from the indoor heat exchanger to the outdoor heat exchanger through the bi-flow expansion valve assembly; thereafter
c. placing the reversing valve in the first operating mode and adjusting the bi-flow expansion valve assembly for metering refrigerant flow from the outdoor heat exchanger to the indoor heat exchanger; and
d. operating the compressor to defrost the outdoor heat exchanger; and, at completion of defrost
e. re-adjusting the bi-flow expansion valve assembly to permit unrestricted flow through the refrigerant line from the outdoor heat exchanger to the indoor heat exchanger while maintaining the reversing valve in the first operating mode;
f. flooding refrigerant from the outdoor heat exchanger to the indoor heat exchanger through the re-adjusted bi-flow expansion valve assembly; and
g. returning the reversing valve to the second operating mode and the bi-flow expansion valve assembly to the condition for metering refrigerant flow from the indoor heat exchanger to the outdoor heat exchanger.

9. A method for defrosting a heat pump having an outdoor evaporator; an indoor condenser; a compressor; refrigerant lines disposed between the compressor and the evaporator, between the compressor and the condenser, and between the evaporator and the condenser; and restriction means for metering refrigerant flow in paths from the evaporator to the condenser and from the condenser to the evaporator; said method comprising the sequential steps of:

a. unrestricting the flow of refrigerant in a path from the condenser to the evaporator;
b. flooding liquid refrigerant from the condenser to the evaporator;
c. restricting the flow of refrigerant in a path from the evaporator to the condenser;
d. operating the heat pump in a conventional defrost mode, by directing refrigerant vapor from the compressor to the evaporator;
e. unrestricting the flow of refrigerant in a path from the evaporator to the condenser;
f. flooding refrigerant from the evaporator to the condenser;
g. restricting the flow of refrigerant in a path from the condenser to the evaporator; and
h. resuming conventional heat pump operation.

10. In an air conditioning device having first and second heat exchangers, one of said heat exchangers operating as an evaporator and the other of said heat exchangers operating as a condenser; a compressor; refrigerant lines disposed between the heat exchangers and between the compressor and the heat exchangers; and a reversing valve for directing refrigerant from the compressor to either of said heat exchangers, the improvement comprising: means initiated for a short time period at start up to cause flooding of refrigerant from said heat exchanger operating as a evaporator to said heat exchanger operating as a condenser.

11. The air conditioning device defined in claim 10, wherein said flooding means includes a bi-flow expansion valve assembly disposed in the refrigerant line between said first and second heat exchangers having a first path therethrough for metering the flow of refrigerant between said first and second heat exchangers and second path therethrough for allowing the flow of refrigerant between said first and second heat exchangers substantially unrestricted by said bi-flow expansion valve assembly.

12. A method for rapidly achieving steady state operation of a heat pump system having a low pressure portion and a high pressure portion, said method comprising the sequential steps at start up of:

a. providing a substantially unrestricted path for the flow of refrigerant from the low pressure portion of the systems to the high pressure portion of the systems;
b. flooding refrigerant from said low pressure portion of the system to said high pressure portion of the system; and
c. providing a restricted path for metering refrigerant flow from the high pressure portion of the system to the low pressure portion of the system.

* * * * *